US007360758B2

(12) United States Patent
Drago et al.

(10) Patent No.: US 7,360,758 B2
(45) Date of Patent: Apr. 22, 2008

(54) ACCUMULATOR APPARATUS NON-MARRING PUSHER SYSTEM

(75) Inventors: Michael R. Drago, Bethlehem, PA (US); John J. Semanick, Bethlehem, PA (US); John H. Vitko, Easton, PA (US)

(73) Assignee: Bowe Bell + Howell Company, Durham, NC (US)

( * ) Notice: Subject to any disclaimer, the term of this patent is extended or adjusted under 35 U.S.C. 154(b) by 447 days.

(21) Appl. No.: 10/943,853

(22) Filed: Sep. 20, 2004

(65) Prior Publication Data

US 2006/0071409 A1 Apr. 6, 2006

(51) Int. Cl.
*B65H 85/00* (2006.01)

(52) U.S. Cl. ..... 271/3.03; 271/3.01; 271/3.14

(58) Field of Classification Search ..... 271/3.01, 271/3.03, 3.14; 414/788.1, 788.7, 788.8, 414/788.9, 789, 789.9, 791.1, 792.7, 795; 198/418.3, 419.1
See application file for complete search history.

(56) References Cited

U.S. PATENT DOCUMENTS 3,150,578 A * 9/1964 Ingvald et al. ..... 414/790.3
3,321,202 A * 5/1967 Martin ..... 271/199
3,557,667 A * 1/1971 Molla ..... 83/88
4,799,663 A * 1/1989 Golicz ..... 271/199
5,207,727 A * 5/1993 Pearce et al. ..... 414/792.7
5,244,200 A * 9/1993 Manzke ..... 271/198
5,433,431 A * 7/1995 Lowell ..... 271/273
5,484,255 A 1/1996 Lowell
5,775,689 A 7/1998 Moser et al.
5,899,453 A * 5/1999 Middelberg et al. ..... 271/184
6,203,006 B1 3/2001 Semanick et al.
6,386,537 B1 * 5/2002 Howard et al. ..... 271/303
6,551,052 B2 * 4/2003 Bakoledis ..... 414/790.3
6,599,081 B1 * 7/2003 Blidung et al. ..... 414/796.4
6,634,852 B2 * 10/2003 Bakoledis ..... 414/789
6,712,354 B1 3/2004 Semanick
6,902,162 B2 * 6/2005 Otto et al. ..... 271/207
2003/0151190 A1 * 8/2003 Otto et al. ..... 271/207

* cited by examiner

*Primary Examiner*—Patrick Mackey
*Assistant Examiner*—Gerald W McClain
(74) *Attorney, Agent, or Firm*—McDermott Will & Emery LLP

(57) ABSTRACT

An accumulator apparatus for accumulating one or more sheets or articles is provided and includes a sheet accumulator portion for accumulating one or more sheets or articles, a ramp disposed upstream of the sheet accumulator portion relative to a flow direction of the sheet or article, an actuator and a pusher plate connected to the actuator. The actuator is configured to move the pusher plate away from the ramp in a direction toward a sheet accumulation portion of the accumulator apparatus.

20 Claims, 9 Drawing Sheets

ACCUMULATOR APPARATUS NON-MARRING PUSHER SYSTEM

TECHNICAL FIELD

The present subject matter relates generally to accumulator apparatuses and methods for accumulating sheets and/or articles. More particularly, the present subject matter relates to an improved non-marking accumulator apparatus and method for reducing or eliminating unintended marking of sheets or articles caused by conventional accumulator apparatuses and conveyance devices.

BACKGROUND

Various accumulator apparatuses and methods have been employed in the past for accumulating sheet material or articles such as paper sheets, documents, and the like into stacks for subsequent advancement. Such accumulator apparatuses and methods have particular use in high-speed mail processing where preparation and processing of mailable articles (e.g., bills, account statements) often requires a plurality of sheets and/or articles to be assembled into a packet for further handling which can include, for example, folding, inserting, and collating.

Examples of conventional accumulator apparatuses are shown in U.S. Pat. No. 5,244,200 to Manzke; U.S. Pat. No. 5,775,689 to Moser et al., U.S. Pat. No. 6,203,006 to Semanick et al., and U.S. Pat. No. 6,712,354 to Semanick, each of these patents being commonly assigned herewith and incorporated herein by reference in its entirety. These references disclose an accumulator apparatus utilizing driven endless elastic belts that feed sheets therebetween along a sheet-feeding path. Ramps are provided to deflect sheets out of the sheet-feeding path and accumulate the sheets in an accumulator located between the ramps and a stop.

Consider U.S. Pat. No. 5,775,689 to Moser et al., as an example. FIGS. 1 and 2 show the device from that patent. As shown, accumulator apparatus 10 comprises an upper and a lower belt means adapted to convey sheets and/or articles therebetween. Each of the upper and lower belt means UB, LB comprises a plurality of spaced-apart endless elastic polycord belts driven by a suitable drive member. The upper belts UB include lower reaches 20 and the lower belts LB include upper reaches 22, as shown in FIGS. 1-2. The upper and lower belts UB, LB are driven so that lower and upper reaches 20, 22 move at substantially the same speed in a common direction through accumulator apparatus 10 to thereby define a generally horizontal conveyance of sheet and/or articles processed through accumulator apparatus 10, such as indicated by entry and exit arrows 12, 14, shown in FIG. 2.

At the accumulator apparatus 10 entrance, sheets and/or articles advance into the accumulator apparatus between the upper belts UB and lower belts LB, where entry roller guide means 40 are provided and comprise a plurality of upper guide rollers 42 fixedly attached in a spaced-apart relationship to rotatable shaft 44 and a plurality of lower guide rollers 46 fixedly attached in a spaced-apart relationship to rotatable shaft 48. The upper belt means UB and lower belt means LB respectively extend around upper guide rollers 42 and lower guide rollers 46, as shown in FIGS. 1-2. The upper guide rollers 42 and lower guide rollers 46, in operative association with upper belts UB and lower belts LB, respectively, guide sheets or articles advancing therebetween.

Accumulator apparatus 10 comprises ramp means 80 for deflecting sheets or articles processed between upper belt means UB and lower belt means LB from the horizontal feeding plane. Ramp means 80 can include a plurality of ramp members, such as side ramp members 82 and intermediate ramp members 82A which comprise deflecting surfaces 86 and slots 88 defined therein for extension therethrough of lower reaches 20 of upper belt UB.

Front rollers 100 and rear rollers 110 are spaced about respective shafts 84A, 84C of ramp means 80 to respectively engage the upper reaches 22 of lower belts LB and to align the feeding direction of sheets or articles through accumulator apparatus 10. Upper reaches 22 of lower belts LB extend over and engage front rollers 100 and extend from such above-engaging position with front rollers 100 downwardly and away from lower reaches 20 of upper belts UB where upper reaches 22 of lower belts LB extend engagingly below and past the bottom sides of rear rollers 110. Downstream from rear rollers 110, accumulator apparatus 10 includes a plurality of lower rollers 120 rotatably attached to a shaft, and lower belts LB extend around lower rollers 120 so as to reverse direction back toward lower guide rollers 46, as shown in FIGS. 1-2. Lower rollers 120 and lower guide rollers 46 of entry roller guides means 40 therefore are the outermost opposing rollers around which lower belts LB extend and cycle. Lower rollers 120 are located and maintained in a spaced-apart position from lower reaches 20 of upper belts UB.

Sheets or articles advancing through accumulator apparatus 10 between upper belts UB and lower belts LB will contact and be deflected by ramp members 82 and 82A out of the horizontal feeding plane and over upper edges 96. Lower reaches 20 of upper belts UB can also be diverted upwardly by ramp members 82. Downstream of upper edges 96, a deflected sheet article is urged back toward the horizontal feeding plane by resilient action of lower reaches 20 of upper belts UB due to their tension and/or diversion. Progressive feeding of sheets or articles in the horizontal feeding plane where the sheets or articles are deflected by ramp members 82 and 82A causes over-accumulation of sheets or articles in a stack or accumulation location past upper edges 96 of ramp members 82 and 82A. To support accumulated sheets or articles S, accumulator apparatus 10 comprises support means such as a plurality of spaced-apart supports 98 extending from ramp members 82A and supports 140. The leading edges of sheets or articles accumulated in stack S are positioned against and stopped by stop means 150. Upper stop rollers 152 and lower stop rollers 156 are output rollers adapted for selectively gripping, stopping, and advancing sheets or articles S.

As illustrated in the exemplary patents identified above, accumulators conventionally employ endless upper belts and lower belts for seriatim feeding of sheets or articles therebetween. A problem with accumulator apparatuses and methods employing such endless upper belts and lower belts, however, is that the upper and lower belts can cause smudging of ink or toner or can pick-up residual print material (e.g., ink or toner) from various sheets or other sources and convey the residual print material to other sheets. As shown in FIGS. 1-2, the conventional accumulators have polycord belts extending through the ramps up to the output shaft upon which the output rollers are disposed. While sheets or articles are transported over the ramps (e.g., ramp 80 in FIG. 2), and the sheets accumulate in the accumulator, the polycords continually rotate over the sheets, which causes marking on the sheets or articles.

Accordingly, there remains room for improvement in the art for an accumulator apparatus and method which reduces or eliminates inadvertent marking on the conveyed sheets or articles.

SUMMARY OF THE DISCLOSURE

It is desired to provide an accumulator apparatus that reduces or eliminates inadvertent marking on the conveyed sheet(s) or article(s). It is particularly desired to reduce or eliminate inadvertent marking on the conveyed sheets or articles caused by transference of residual print material from the endless upper and lower belts conventionally used to convey articles through the accumulator apparatus to the conveyed articles.

In accord with the present concepts disclosed herein, there is provided an accumulator apparatus for accumulating sheet(s) or article(s) that does not use polycords to convey sheet(s) or article(s) through the accumulator to the accumulator apparatus outlet. Instead, an actuator pusher plate is provided to facilitate movement of the sheet(s) or article(s) toward the accumulator apparatus output rollers.

In one aspect, there is provided a ramp for an accumulator apparatus for accumulating sheets or articles, the ramp comprising an actuator having a movable member and a pusher plate connected to the movable member, the pusher plate being disposed adjacent a rear end of the ramp. The actuator is configured to move the pusher plate away from the rear end of the ramp in a direction toward a sheet accumulation portion of the accumulator apparatus.

In another aspect, an accumulator apparatus for accumulating sheets or articles is provided, the accumulator apparatus comprising a sheet accumulator portion for accumulating sheets or articles, a ramp disposed upstream of the sheet accumulator portion relative to a flow direction of the sheets or articles, an actuator and a pusher plate connected to the actuator. The actuator is configured to move the pusher plate away from the ramp in a direction toward a sheet accumulation portion of the accumulator apparatus.

In still another aspect, a method for controlling sheets or articles in an accumulator apparatus is provided and comprises the steps of transporting at least one sheet article into an accumulator apparatus accumulator, moving a pusher plate toward and against the at least one sheet article provided in the accumulator apparatus accumulator, using the pusher plate to push the at least one sheet article into a pair of opposing transport rollers disposed at an outlet of the sheet accumulator portion.

Other aspects and advantages of the present disclosure will become apparent to those skilled in this art from the following description of preferred aspects taken in conjunction with the accompanying drawings. As will be realized, the disclosed concepts are capable of other and different embodiments, and its details are capable of modifications in various obvious respects, all without departing from the spirit thereof. Accordingly, the drawings, disclosed aspects, and description are to be regarded as illustrative in nature, and not as restrictive.

BRIEF DESCRIPTION OF THE DRAWINGS

Features and advantages of disclosed examples herein will be apparent from the following illustrations in which like referenced characters refer to the same parts throughout the various views. The drawings are not necessarily to scale, emphasis instead being placed upon illustrating principles of the disclosed examples.

DETAILED DESCRIPTION

Figure 1:
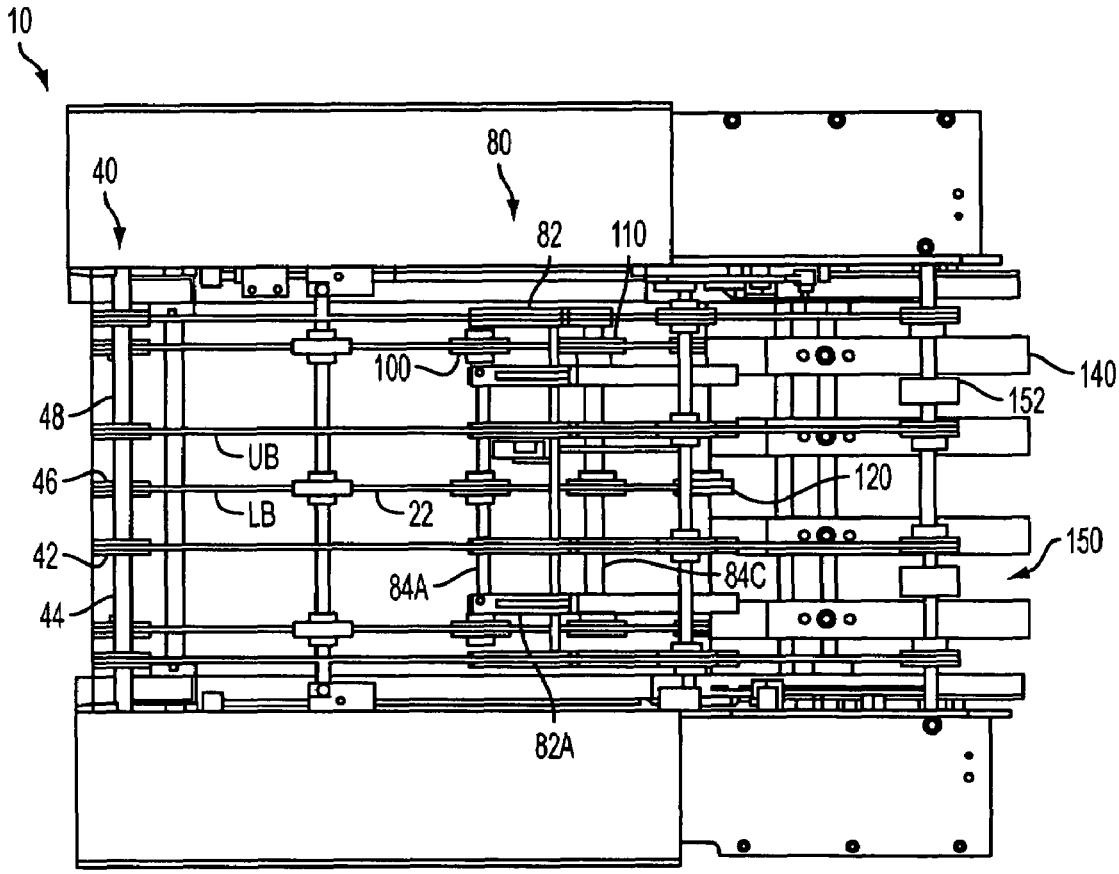
FIG. 1 BACKGROUND ART
FIGS. 1-2 respectively show a top view and a side view of a conventional accumulator apparatus.
Figure 2:
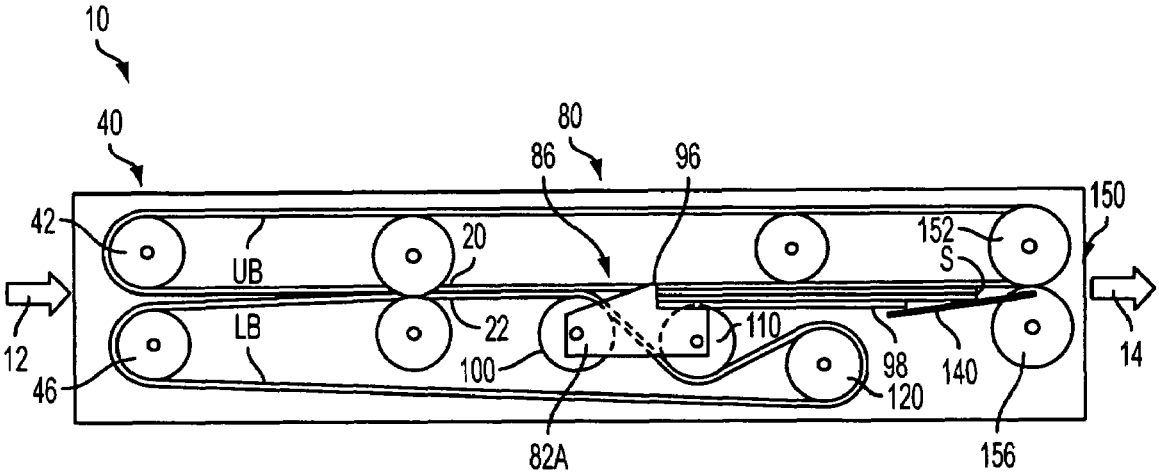
FIG. 2 BACKGROUND ART

An accumulator apparatus 200 in accord with the present concepts is disclosed and shown by way of example in FIGS. 3-8. The basic operation, structure, software and control features of such accumulator apparatuses are well known to those skilled in the art and are omitted herein for brevity.

Whereas the aforementioned background art devices utilize an upper belt means and a lower belt means to convey sheets or articles therebetween over the entire length of the accumulator apparatus, the presently disclosed accumulator apparatus 200 utilizes a drive system comprising a single belt 205, in combination with various pulleys, rollers and guide members, to convey one or more sheet(s) or article(s) only up to and over the ramp(s) 250. Pusher plate 300, operatively associated with an actuator 260, then conveys the sheet(s) or article(s) collected within accumulator 400 to output rollers 500 at an appropriate time, in accord with control signals from the computer program and/or control systems controlling conveyance of the sheet(s) or article(s).

Figure 3:
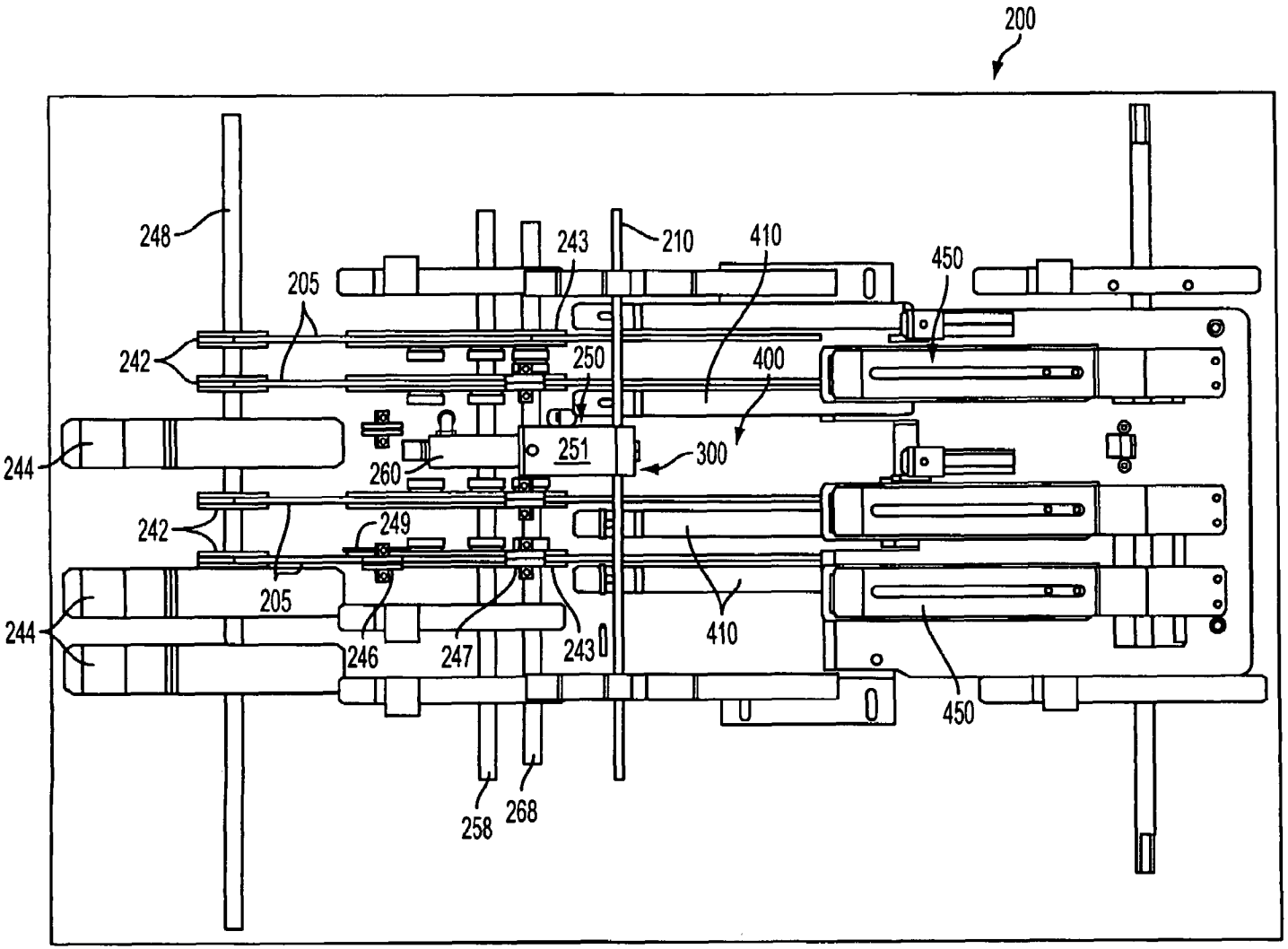
FIG. 3 shows an isometric partial view of an accumulator apparatus in accord with the present concepts.

The drive system of the accumulator apparatus 200 comprises a plurality of spaced-apart belts 205, such as shown in top view of FIG. 3. Belt 205 is, in the illustrated example, an endless belt comprising a round elastic polycord ("spaghetti belts"). It is to be understood that, in other aspects, belt 205 may comprise other combinations of shape and material (e.g., a flat rubber) and may utilize different pulley and/or roller arrangements (e.g., multiple segments or fewer pulleys) other than that shown by way of example in FIGS. 3-8. For example, the drive system of the accumulator apparatus could consist solely of a belt 205 in combination with pulleys 242, 249, and 243). Any suitable conventional device can be utilized to drive belt 205, such as but not limited to an operative interconnection between a shaft with a pulley or roller around which the belt extends. As shown in FIGS. 3-4 and 7-8, pulley 242 is positioned on lower input shaft 248. A clutch/brake system may also advantageously be utilized in combination with drive system. The uppermost span of the belt 205 extends between pulleys 242, 243 to form a generally horizontal feeding plane for sheets and articles processed through the accumulator apparatus 200.

The entry end of accumulator apparatus 200 comprises an entry guide member to facilitate entry of sheets and articles into the accumulator apparatus. In one aspect, the entry guide means comprises an overhead paper guide 244 and front and rear guide rollers 246, 247. It is preferred, but not required, to place at least one of the front and rear guide rollers 246, 247 in opposition to a pulley 249, 243 so as to pinch the incoming sheets and articles therebetween and thereby positively control of the sheet or article conveyance. The shafts about which the front and rear guide rollers 246, 247 are disposed may be translatably fixed or may by selectively translatable toward or away from the belt 205 and opposing pulleys 249, 243 so as to provide a variable bias against the belt means. The front and rear guide rollers 246, 247 may be configured to rotate about a fixed shaft, or may be fixed to a shaft which is passively rotated about or within distal bearings or which may be actively driven. For example, front and rear guide rollers 246, 247 can be rotatably attached to a non-rotatable shaft such that when a sheet article is positioned between these guide rollers and the moving belt 205 which moves to advance the sheet or article, the guide rollers idle without being forcibly drive. The preferred configuration of front and rear guide rollers 246, 247 are positioned on the center of pulleys 249, 243 with belt 205 positioned therebetween. The sheets are preferably controlled via a left and right hand paper side guide (not shown).

Downstream from the entry end of the accumulator apparatus 200, a ramp 250 is disposed to deflect inbound sheets and articles from the horizontal feeding plane. Ramp means 250 may comprise a single ramp or a plurality of ramps. As shown in FIG. 8, a plurality of ramps 250 are provided comprising a central ramp and a plurality of laterally disposed ramps, which may be fixed or translatable in the lateral direction. In the simplified examples of FIGS. 3-4 and 7, only the central ramp 250 is shown for clarity.

Figure 4:
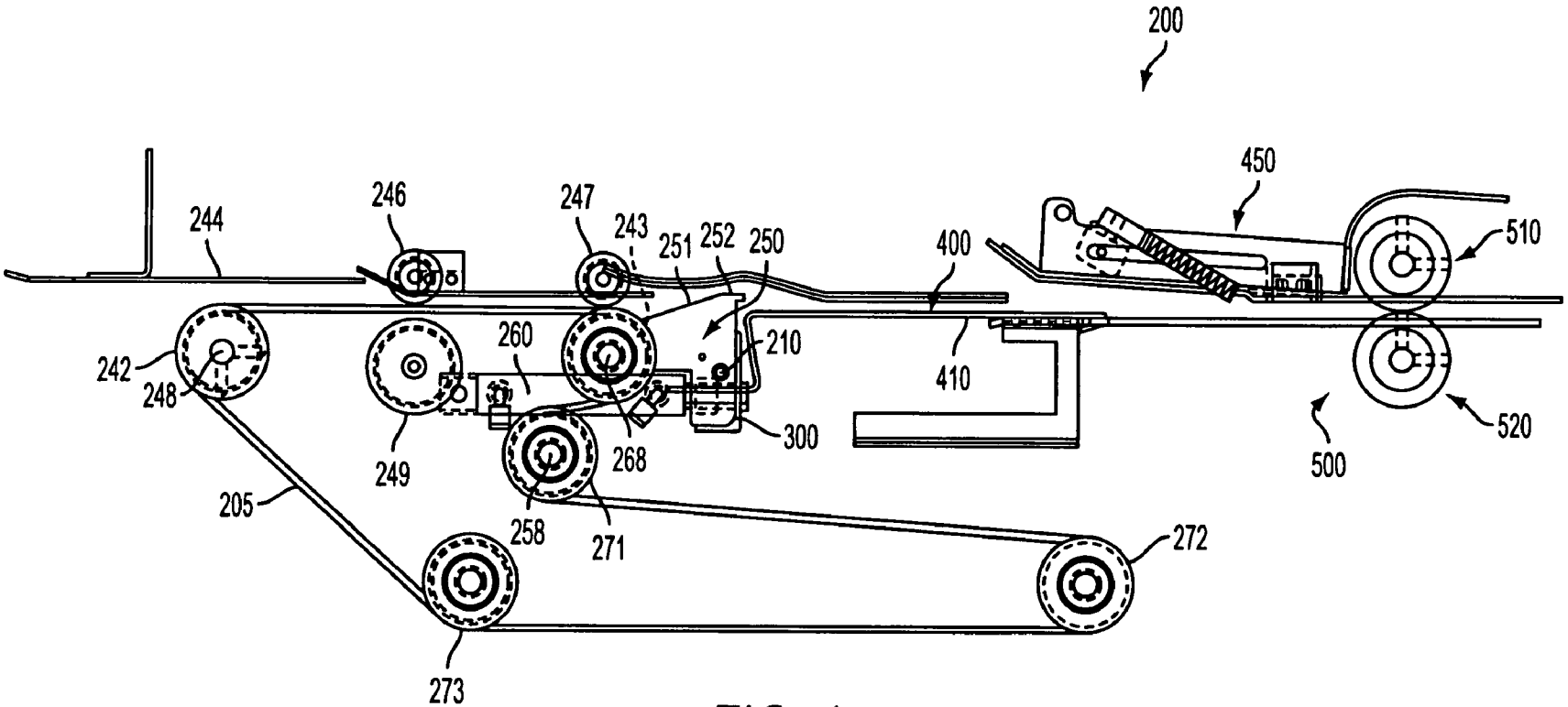
FIG. 4 shows a partial side view of an accumulator apparatus in accord with the present concepts generally depicting the relation between the illustrated components.
Figure 5:
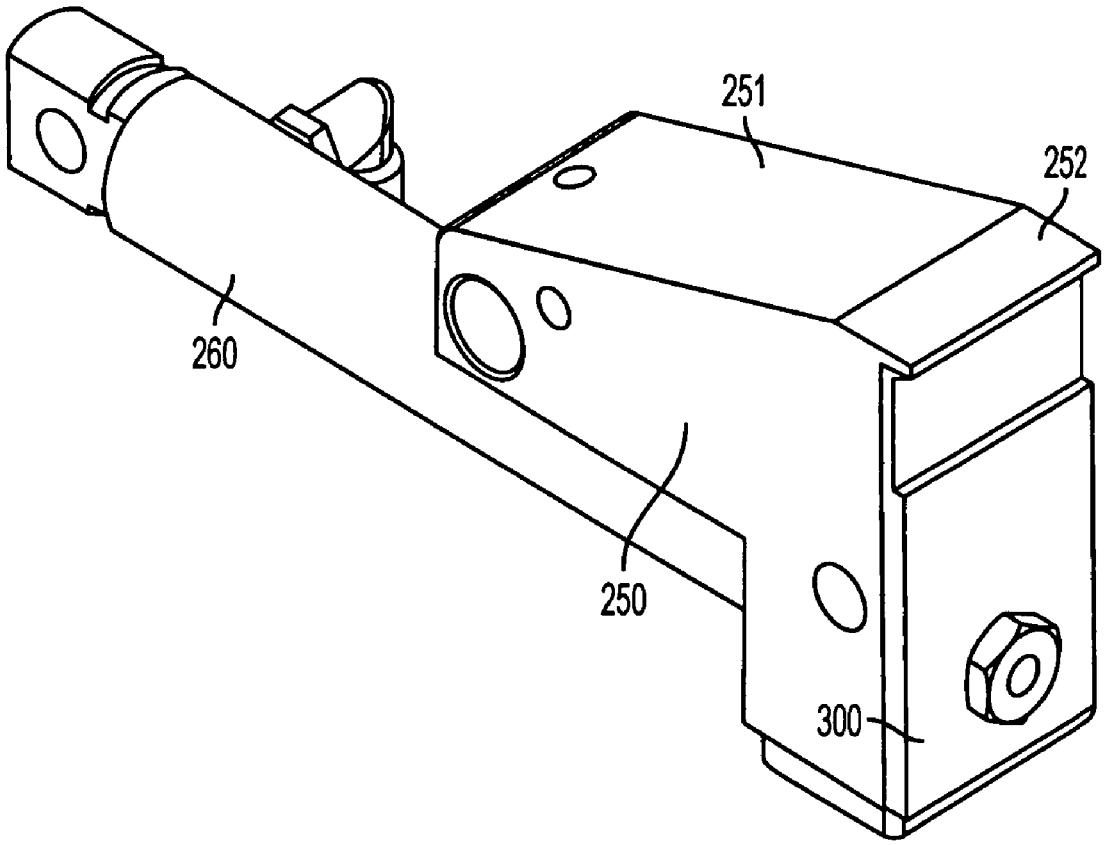
FIG. 5 shows a simplified side view of a portion of an accumulator apparatus in accord with the present concepts.
Figure 6:
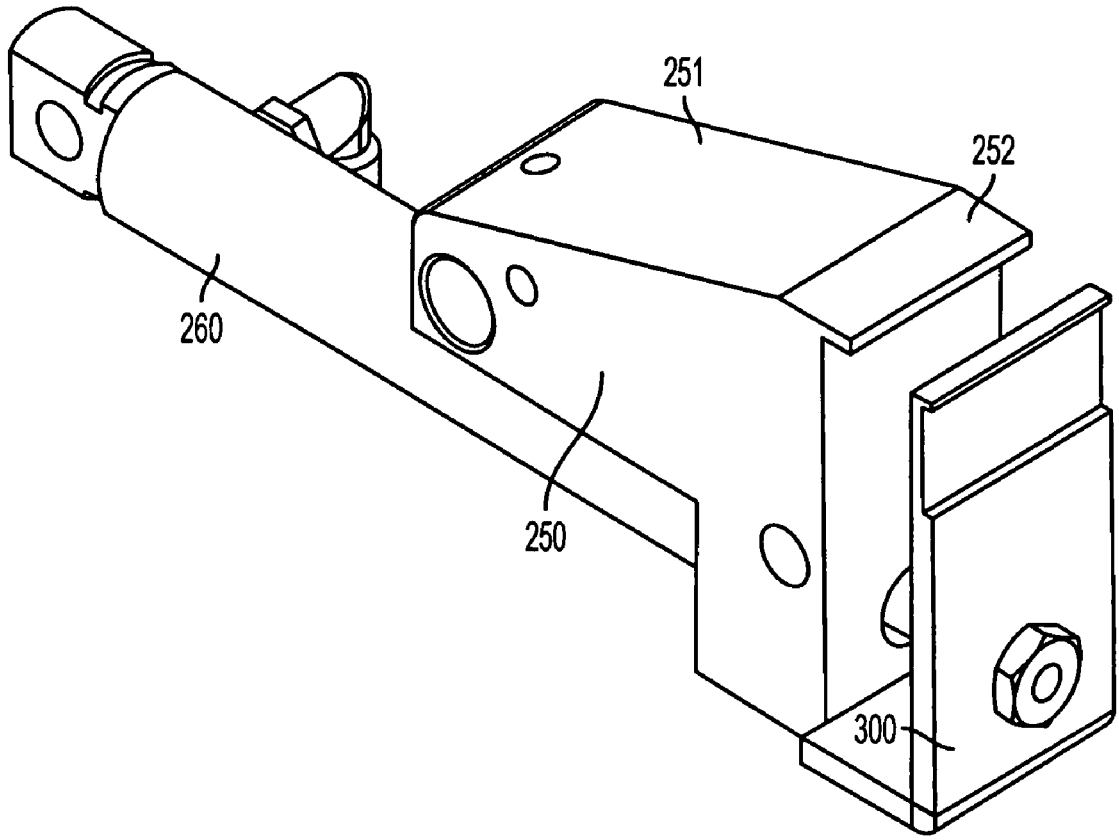
FIG. 6 shows a simplified side view of a portion of an accumulator apparatus in accord with the present concepts.
Figure 7:
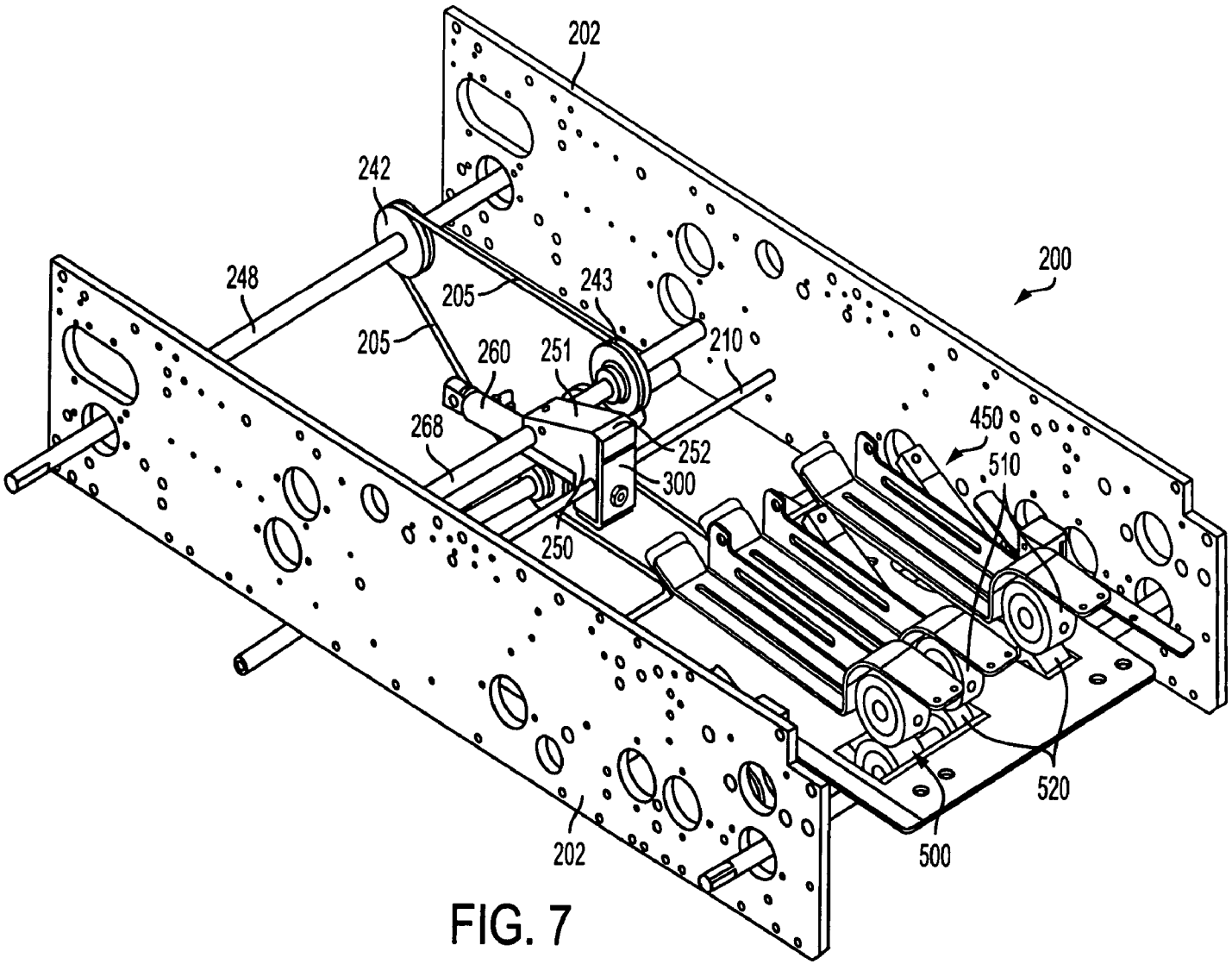
FIG. 7 shows a partial side view of an accumulator apparatus in accord with the present concepts generally depicting the relation between the illustrated components.
Figure 8:
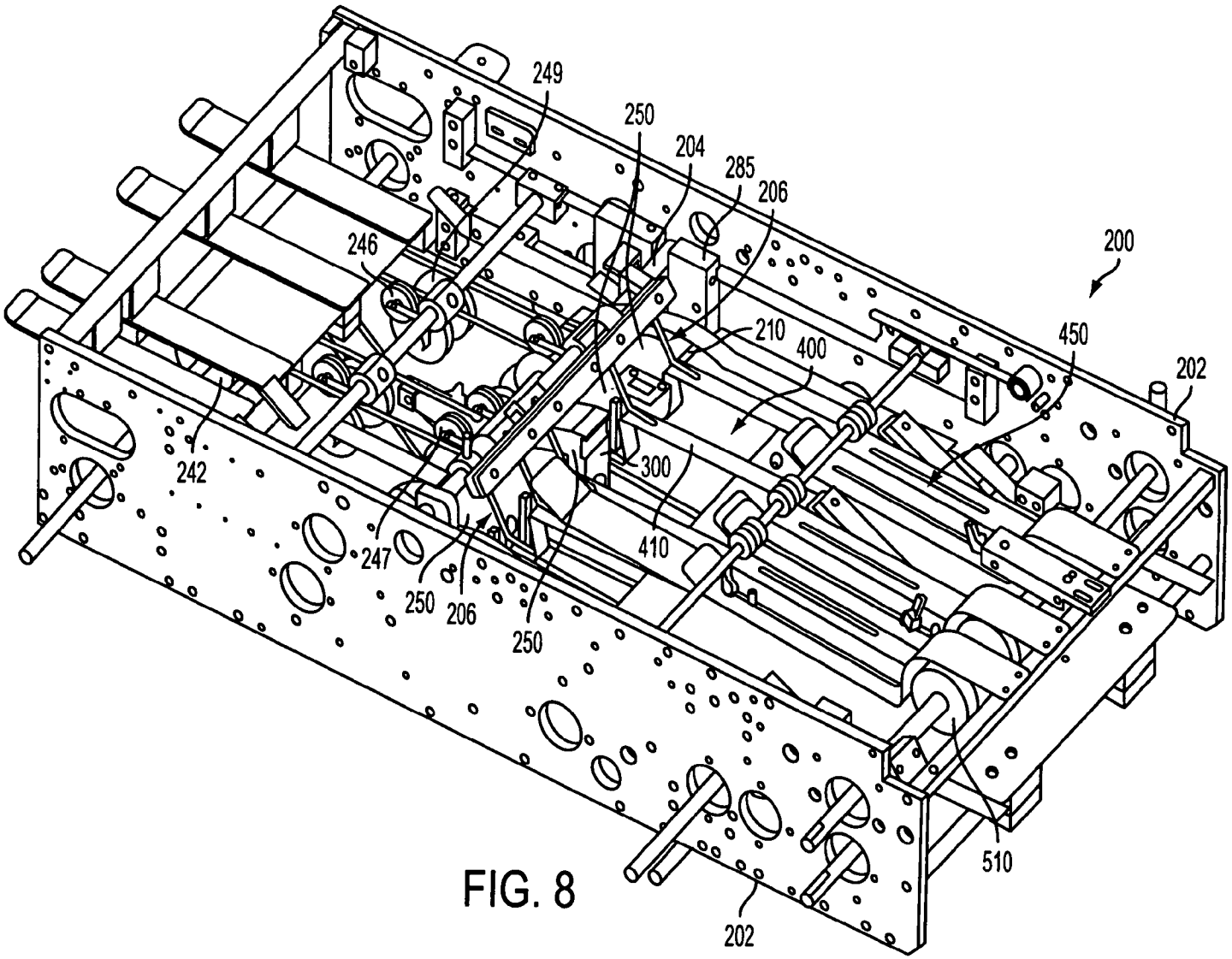
FIG. 8 shows an isometric view of a portion of an accumulator apparatus in accord with the present concepts.

As best shown in FIGS. 3-4 and 7, ramp 250 is operatively interconnected to one or more shafts, such as front shaft 268 and a rear shaft 210, which may be configured to freely rotate within corresponding holes provided in a front portion and a rear portion of the ramp. These shafts 268, 210 may also be used to selectively rotate and/or translate the ramp 250. Although not shown in the simplified views of FIGS. 3-4 and 7, additional lateral ramps configured generally as shown in U.S. Pat. No. 5,775,689, incorporated herein by reference, are provided and may advantageously be similarly operatively interconnected to the front and rear shafts 268, 210.

Referring to FIGS. 3-7, ramp 250 comprises a deflecting surface 251 positioned and configured to intercept the sheet (s) or article(s) conveyed in the horizontal feeding plane defined in part by the belt 205 and deflect the sheet(s) or article(s) away from the horizontal feeding plane. Deflecting surface 251 terminates, on the upper end thereof, at an edge 252, which may be substantially horizontal, angled upwardly, or angled downwardly, and may be rounded. In the illustrated example, ramp 250 is made from aluminum with an optional low-friction coating, but may comprise any durable, preferably low friction material. For example, suitable materials could include a Nylatron GS material or a stainless steel comprising a low-friction coating (e.g., a 95% PEEK/5% PFTE powder coating for application to stainless steel) to reduce friction and static charge. Another example includes a ramp 250 made from aluminum with an electroless nickel plate which reduces friction and eliminates static charge. Deflecting surface 251 is, in the illustrated example, about 2.5 inches long overall in a direction of conveyance, inclusive of an edge 252 that is about 0.40 inches long, and about 1.00 inch in width. The height on the rear end of the ramp is approximately 2.00 inches. The angle of the deflecting surface is between about 16°-17°, but may be freely varied to achieve desired deflection characteristics.

In an embodiment wherein the pusher plate 300 and actuator 260 are integrated with the ramp 250, the rear end of ramp edge 252 may be optionally cantilevered past the rear surface of the ramp 250 rear end to form a ledge about 0.158 inches. This optional ledge forms a seat against which the upper end of the pusher plate 300 may slide as it moves toward and away from the rear surface of the ramp 250. Further, the ramp may be advantageously adapted to facilitate movement of the actuator 260 driving member (e.g., shaft) to thereby move the pusher plate relative to the stationary ramp. For example, if the actuator 260 comprises a reciprocating or linearly translating shaft, the bottom portion of ramp 250 may comprise a through hole to accommodate such shaft. The shaft is then connected via conventional mechanical connection means (e.g., mechanical fastener, weld, etc.) to the pusher plate 300 on an opposite side of the through hole. The pusher plate 300 is optionally L-shaped, comprising a horizontal member extending along a bottom portion of ramp 250 so as to slide along an underside of the ramp over at least a portion of the initial and terminal portions of the pusher plate movement. One or more horizontal members may also be alternatively or additionally arranged on the sides of ramp 250.

Actuator 260 may generally comprise a pneumatic actuator, hydraulic actuator, solenoid actuator, roller screw actuator, electromechanical actuator, mechanical actuator, linear actuator, rotary actuator, motor-operated actuator, or any other conventional actuation means by which the pusher plate 300 may be moved from a first position to a second position using the movable member of the actuator to effect a corresponding movement of a sheet, an article, or a plurality of sheets and/or articles toward an output of the accumulator. For example, in various aspects, actuator 260 may only generate a positive driving force in one direction ("driving stroke"), and the return stroke may be accomplished using a biasing element, such as a spring, or the converse may be arranged. In the illustrated embodiment, actuator 260 comprises a Bimba Manufacturing Co. actuator (P/N D-68152A-0.5) having a stroke of 0.50". The stroke length for the depicted actuator 260, or any other actuating means, may be adapted to suit the particular accumulator 200 configuration and output device.

Actuator 260 does not have to be integrated with a ramp 250 in the manner shown in FIGS. 3-8. Actuator 260 may be disposed at any location within or about accumulator 200 consistent with the actuator's ability to utilize the actuation device or movable member (e.g., a shaft) to move a pusher plate (e.g. 300) from a first position wherein the sheet(s) and/or article(s) within the accumulator 400 are not in contact with the accumulator output device 500, which may comprise a plurality of output rollers 510, 520 in the illustrated embodiment, to a second position wherein the sheet(s) and/or article(s) in the accumulator are in contact with the accumulator output device or are otherwise positioned for imminent release or output from accumulator apparatus 200. As shown in the embodiment illustrated in FIGS. 5-6, pusher plate 300 is illustrated in the first and second position, respectively.

Figure 9:
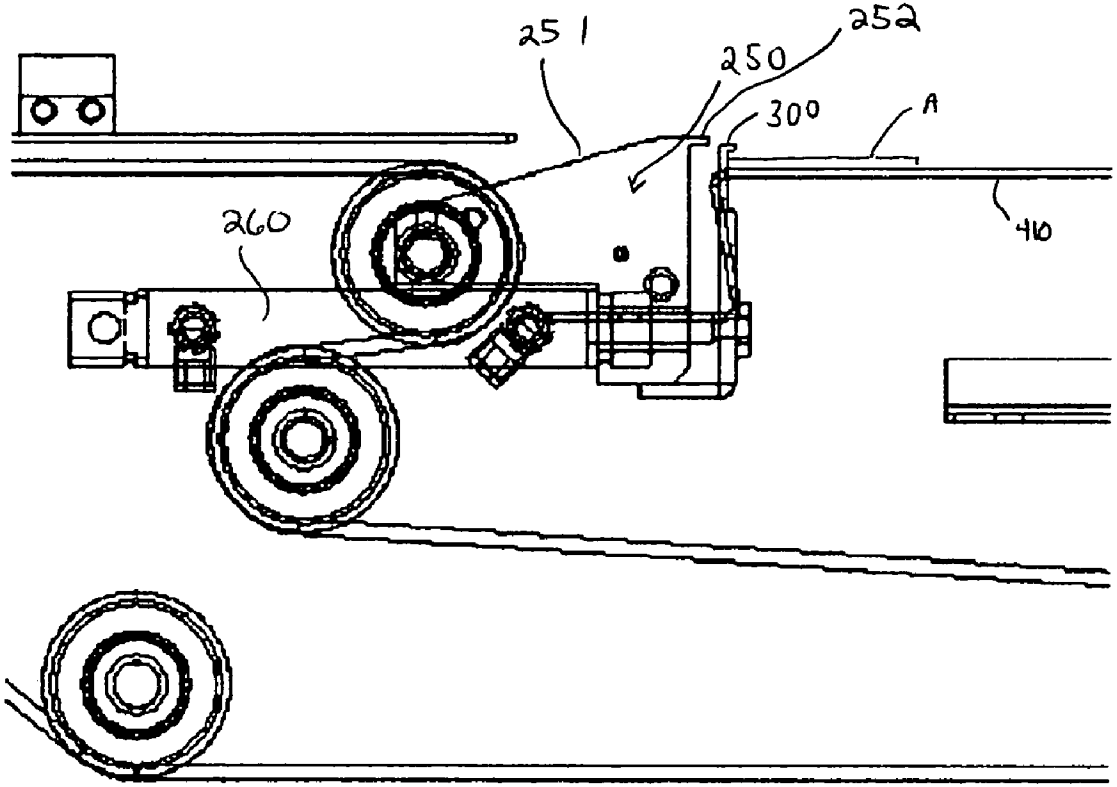
FIG. 9 shows a partial side view of an accumulator apparatus in accord with the present concepts generally depicting the relation between the illustrated components.

FIG. 9 is similar to FIG. 4, except that FIG. 9 shows the pusher plate 300 in contact with the trailing edge of the sheet article(s) A.

As shown in the embodiment illustrated in FIGS. 3-4 and 7-8, pulleys 243 are distributed about shaft 268 on both sides of ramp 250 to guide conveyed sheets and articles without skew. The arrangement of the remaining pulleys 271-273 may be selected in accord, as well as the number of the remaining pulleys is variable and may be selected so long as no jamming occurs. Pulley 271 is positioned on lower support shaft 258. Preferably, four belts 205 are used to stabilize the paper such that no jamming occurs. As for the upper guide rollers 246 and 247, there are preferably two guide rollers 246 used to transport the paper into three guide rollers 247 to assist the paper going over the ramp(s) 250. It has been found through testing that when 3 guide rollers 247 are utilized, the paper is consistently driven over the ramp(s) 250.

Sheets and/or articles advancing through accumulator apparatus 200 between the belt 205 and the guide members 244 and guide rollers 246, 247 or the like, will contact and be deflected by the ramp(s) 250 out of the horizontal feeding plane. The belt 205 can also be diverted upwardly by the lateral ramp members 250, as will be appreciated by those of skill in the art. Downstream of the ramp(s) 250, a deflected sheet or article is urged back toward the horizontal feeding plane by a deflection means, such as an overhead mechanical paper guide or other conventional contact or non-contact (e.g., air impingement) guide means. Progressive seriatim feeding of sheets or articles in the horizontal feeding plane past the ramp(s) 250 provides an accumulation of such sheets or articles in a stack in the accumulator 400.

To support sheets and/or articles accumulated in the accumulator 400, accumulator apparatus 200 comprises support 410. In one embodiment, support 410 comprises a plurality of spaced-apart supports. As shown in FIG. 4, the support 410 upper surface is arranged near and slightly beneath the upper end of ramp edge 252 at a depth corresponding substantially to a predetermined maximum height of accumulated sheets or articles. FIG. 3 shows that the pusher member 300, connected to and driven by actuator 260 through ramp 250 travels between the support 410.

FIG. 8 shows an isometric partial view of an accumulator apparatus 200 in accord with the present concepts. Accumulator apparatus 200 comprises side plates 202 with a number of shafts and structures fixedly or rotatably mounted thereto or passed therethrough for mounting to external machines, components, or driving members. Attached to shaft 204 are sheet guide members 206, which may angled as shown in FIG. 8 or may be straight, adapted to contact and guide an upper surface of a conveyed sheet or article. Other conventional sheet or article guide means, such as overhead guides 450 bearing knockdown brushes, are also preferably provided. A detailed description thereof is omitted for brevity.

To summarize, a sheet enters the accumulator apparatus 200 between overhead paper guide 244 and front pulley 242. The belts 205, which are spaced laterally along the accumulator apparatus 200, frictionally engage the entering sheet and pull the sheet toward and under guide rollers 246, 247 and over pulleys 249, 243 prior to encountering the ramps 250, also spaced laterally along the accumulator apparatus. The ramps 250 deflect the sheet out of the horizontal feeding plane as additional overhead guide members deflect the leading edge of the conveyed sheet downwardly into the accumulator 400, where sheets are temporarily stored before being advanced to the accumulator apparatus output. The control system will, at the appropriate time, issue a control signal instructing the actuator 260 to move the pusher plate 300 toward the accumulator apparatus 200 outlet sufficiently to advance the accumulated sheet or sheets (e.g., a billing statement for a customer) out of the accumulator apparatus. In the illustrated example, output rollers 510, 520 are provided to engage and convey the accumulated sheets from the accumulator. Once the accumulator 400 is emptied and the pusher plate 300 moved to a position out of the flow path of the incoming sheets, the accumulator apparatus 200 is again ready for another cycle.

While the present disclosure sets forth a description of a practical and preferred embodiment, it is understood that the concepts disclosed herein are not limited to the disclosed embodiment, but on the contrary, is intended to cover various modifications and equivalent arrangements included within the spirit and scope of the appended claims. The disclosed concepts are readily capable of other different embodiments and its several details are capable of modifications in various obvious respects, all without departing from the concepts disclosed herein. The appended figures and description are to be regarded as illustrative in nature, and not as restrictive.

The invention claimed is:

1. A ramp for an accumulator apparatus for accumulating one or more sheets or articles, said ramp comprising:

an actuator having a movable member, the movable member adapted to extend and retract through an opening disposed adjacent a rear end of the ramp; and a pusher plate connected to the movable member, the pusher plate being disposed adjacent the rear end of the ramp, wherein the actuator is configured to move the pusher plate away from the rear end of the ramp in a direction toward a sheet accumulation portion of the accumulator apparatus and the pusher plate is configured to advance the one or more accumulated sheets or articles in a direction away from the sheet accumulation portion of the accumulator apparatus.

2. A ramp for an accumulator apparatus for accumulating one or more sheets or articles according to claim 1, wherein the actuator comprises at least one of a pneumatic actuator, hydraulic actuator, solenoid actuator, roller screw actuator, electro-mechanical actuator, mechanical actuator, linear actuator, rotary actuator, and motor-operated actuator.

3. A ramp for an accumulator apparatus for accumulating one or more sheets or articles according to claim 1, wherein the actuator is disposed adjacent a front end of the ramp.

4. A ramp for an accumulator apparatus for accumulating one or more sheets or articles according to claim 3, wherein the pusher plate comprises a vertical section that substantially corresponds in height to the rear end of the ramp.

5. A ramp for an accumulator apparatus for accumulating one or more sheets or articles according to claim 4, wherein the pusher plate comprises a horizontal section extending below the rear end of the ramp.

6. An accumulator apparatus for accumulating one or more sheets or articles, said accumulator apparatus comprising:

a sheet accumulator portion for accumulating one or more sheets or articles;

a ramp disposed upstream of the sheet accumulator portion relative to a flow direction of the one or more sheets or articles;

an actuator having a movable member, the movable member adapted to extend and retract through an opening disposed adjacent a rear end of the ramp; and a pusher plate connected to the actuator, wherein the actuator is configured to move the pusher plate away from the ramp in a direction toward a sheet accumulation portion of the accumulator apparatus and the pusher plate is configured to advance the one or more accumulated sheets or articles in a direction away from the sheet accumulation portion of the accumulator apparatus.

7. An accumulator apparatus for accumulating one or more sheets or articles according to claim 6, wherein the actuator comprises at least one of a pneumatic actuator, hydraulic actuator, solenoid actuator, roller screw actuator, electro-mechanical actuator, mechanical actuator, linear actuator, rotary actuator, and motor-operated actuator.

8. An accumulator apparatus for accumulating one or more sheets or articles according to claim 6, wherein the actuator is disposed adjacent a front end of the ramp.

9. An accumulator apparatus for accumulating one or more sheets or articles according to claim 8, wherein the pusher plate is disposed adjacent a rear end of the ramp.

10. An accumulator apparatus for accumulating one or more sheets or articles according to claim 9, wherein the pusher plate comprises a vertical section that substantially corresponds in height to the rear end of the ramp.

11. An accumulator apparatus for accumulating one or more sheets or articles according to claim 10, wherein the pusher plate comprises a horizontal section extending below a rear end of the ramp.

12. An accumulator apparatus for accumulating one or more sheets or articles according to claim 7, wherein the actuator is configured to move the pusher plate between a retracted position and an extended position.

13. An accumulator apparatus for accumulating one or more sheets or articles according to claim 12, wherein an extended position of the pusher plate biases the pusher plate against a trailing edge of a sheet article or a plurality of one or more sheets or articles disposed within the sheet accumulator portion.

14. An accumulator apparatus for accumulating one or more sheets or articles according to claim 13, further comprising:

at least one transport roller disposed at an outlet of the sheet accumulator portion, and a driver for driving the transport roller.

15. An accumulator apparatus for accumulating one or more sheets or articles according to claim 14, wherein biasing of the pusher plate against a trailing edge of a sheet article or a plurality of one or more sheets or articles disposed within the sheet accumulator portion in turn biases a leading edge of the sheet article or plurality of one or more sheets or articles against the at least one transport roller to output the sheet article or plurality of one or more sheets or articles from the accumulator apparatus.

16. An accumulator apparatus for accumulating one or more sheets or articles according to claim 14, wherein biasing of the pusher plate against a trailing edge of the sheet article or plurality of one or more sheets or articles disposed within the sheet accumulator portion translates the sheet article or plurality of one or more sheets or articles toward and against the at least one transport roller to permit the at least one transport roller to sequentially output the sheet article or plurality of one or more sheets or articles from the accumulator apparatus.

17. An accumulator apparatus for accumulating one or more sheets or articles according to claim 14, further comprising:

a pair of opposing transport rollers disposed at an outlet of the sheet accumulator portion, at least one driver for driving the pair of opposing transport rollers, wherein, in an extended position of the pusher plate, at least a portion of the pusher plate extends within the sheet accumulator portion to bias at least one sheet article therein against and between the pair of opposing transport rollers.

18. A method for controlling a plurality of one or more sheets or articles in an accumulator apparatus comprising the steps of:

transporting at least one sheet article into an accumulator apparatus;

moving a pusher plate toward and against the at least one sheet article provided in the accumulator apparatus, by way of an actuator having a movable member, the movable member adapted to extend and retract through an opening disposed adjacent a rear end of a ramp;

using the pusher plate to advance the at least one sheet article toward a pair of opposing transport rollers disposed at an outlet of the sheet accumulator portion.

19. A method for controlling a plurality of one or more sheets or articles in an accumulator apparatus according to claim 18, comprising the steps of:

transporting the at least one sheet article from the accumulator apparatus accumulator using the pair of opposing transport rollers.

20. A method for controlling a plurality of one or more sheets or articles in an accumulator apparatus according to claim 19, comprising the steps of:

moving the pusher plate away from the at least one sheet article following delivery of the at least one sheet article to the pair of opposing transport rollers.

* * * * *